US005413297A

United States Patent [19]

Adams

[11] Patent Number: 5,413,297

[45] Date of Patent: May 9, 1995

[54] DOOR HOOK

[75] Inventor: William E. Adams, Butler County, Pa.

[73] Assignee: Adams Mfg. Corp., Portersville, Pa.

[21] Appl. No.: 182,738

[22] Filed: Jan. 14, 1994

[51] Int. Cl.[6] ..... A47B 96/06

[52] U.S. Cl. ..... 248/215; 248/304; 248/914

[58] Field of Search ..... 248/208, 225.2, 215, 248/227, 217.1, 304, 301, 914

[56] References Cited

U.S. PATENT DOCUMENTS

| | | | |
|---|---|---|---|
| D. 275,917 | 10/1984 | Einborn . | |
| D. 342,889 | 1/1994 | Adams | D8/367 |
| 1,474,660 | 11/1923 | White . | |
| 1,501,807 | 7/1924 | Petschel . | |
| 2,346,276 | 4/1944 | Reittinger | 248/215 |
| 2,447,128 | 8/1948 | Logan | 248/290 |
| 2,565,719 | 8/1951 | Church | 248/215 |
| 2,606,734 | 8/1952 | Magnuson | 248/215 |
| 2,631,803 | 3/1953 | Meyers | 248/215 |
| 2,738,188 | 3/1956 | Hoffman | 248/215 X |
| 2,743,023 | 4/1956 | Larson | 211/96 |
| 2,954,954 | 10/1960 | Larson | 248/215 |
| 3,112,911 | 12/1963 | Cornwell | 248/215 |
| 3,536,287 | 10/1970 | Kramer | 248/301 |
| 3,630,475 | 12/1971 | Barry | 248/215 |
| 4,387,873 | 6/1983 | Pavlo et al. | 248/226.4 |
| 4,846,430 | 7/1989 | Ke | 248/215 |
| 4,880,133 | 11/1989 | Cullinane | 248/215 X |
| 4,979,712 | 12/1990 | Rios | 248/215 |
| 5,094,417 | 3/1992 | Creed | 248/215 |

FOREIGN PATENT DOCUMENTS

| | | | |
|---|---|---|---|
| 2275176 | 2/1960 | France | 355/248 |
| 804351 | 4/1951 | Germany | 248/215 |
| 1236 | 1/1892 | United Kingdom | 248/215 |
| 1278118 | 6/1972 | United Kingdom | 248/215 |

OTHER PUBLICATIONS

Product sheet titled Adams Invisibles TM Transparent Hooks and Holders.

Adams Mfg. Detailer Retail Program Narrow Blister Suction Cups dated Jul. 1, 1992.

*Primary Examiner*—Ramon O. Ramirez

*Attorney, Agent, or Firm*—Buchanan Ingersoll; Lynn J. Alstadt

[57] ABSTRACT

An improved door nook or bracket which is thin enough to fit between the top of the door and the jamb, and strong enough to hold significant weight when the door is opened. The door hook is comprised of a U-shaped bracket, a compressible pad and a hook. The bracket comprises a top having a bottom surface, a front side having a hook and a back side. The front side is attached to one edge of the top at an acute angle relative to the bottom surface of the top. The compressible pad is attached to the bottom surface of the top. The compressible pad preferably has a releasable adhesive. Flexible molded-in minor protrusions may be used as the compressible pad.

12 Claims, 2 Drawing Sheets

DOOR HOOK

BACKGROUND OF THE INVENTION

1. Field of the Invention

The present invention relates to improvements in an over-the-door nook.

2. Description of the Prior Art

Door hooks in prior art are too thick to close a door safely without damaging a door. They have, in many cases, actually weakened the very hinges that hold the door, and also compressed and damaged both wood in the door and the jamb.

Door hooks which are thin enough to close a vast majority of doors safely have been developed. However, these door hooks will not hold objects of significant weights when the door is open. The door hooks are lifted and the objects fall to the ground.

There is a need for an over-the-door hook which can hold significant weight when the door is open, and which permits the door to be closed.

SUMMARY OF THE INVENTION

An object of the present invention is to provide a door hook thin enough to fit between the top of the door and the jamb, and strong enough to hold any significant weight when the door is open.

The door hook of the present invention is comprised of a U-shaped bracket, a hook and a compressible pad. The bracket is comprised of a top, a front side and a back side. The front side has a hook and is angled inwardly toward the back side. The back side is also preferably angled inwardly toward the front side. Acute angles between the front side and the top and/or between the back side and the top increase holding power of the door hook.

The compressible pad is about 0.020 to 0.030 inches thick. When the compressible pad is put under a bottom surface of the top, the door hook will hold as much as ten to fifteen times more weight than it would hold without the pad. A compressible pad with a releasable adhesive is preferred.

Minor protrusions molded into the bottom surface of the top may provide the same holding advantages as the compressible pad.

DETAILED DESCRIPTION OF THE INVENTION

Figure 1:
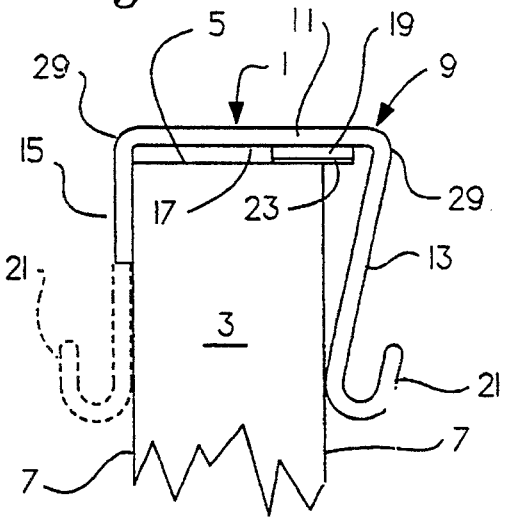
FIG. 1 is a side view of a first present preferred embodiment of a door hook secured over a door.
Figure 2:
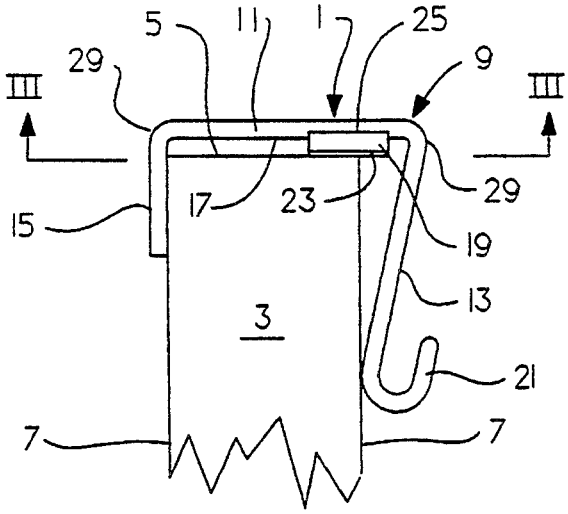
FIG. 2 is a side view of a second present preferred embodiment of a door hook secured over a door.
Figure 7:
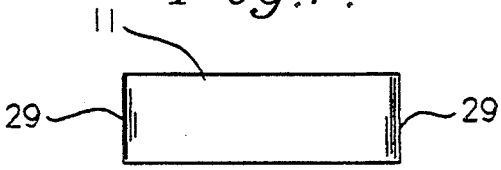
FIG. 7 is a top view of the door hook of the first present preferred embidment, the second embodiment and the third embodiment.
Figure 4:
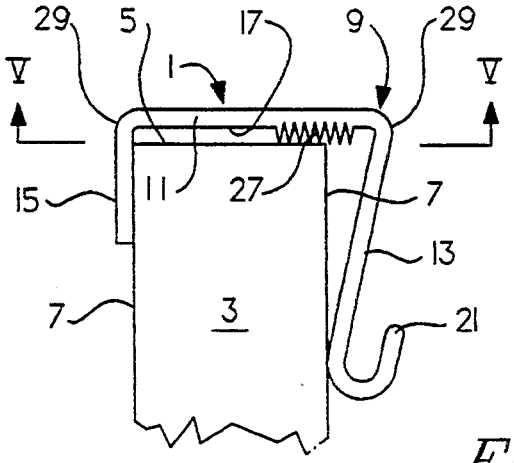
FIG. 4 is a side view of a third present preferred embodiment of a door hook secured over a door.
Figure 5:
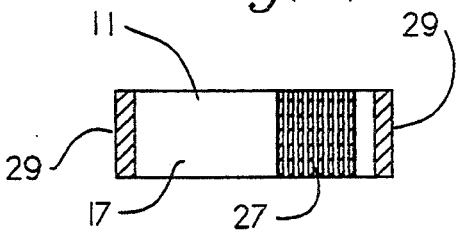
FIG. 5 is a cross-sectional view of the door hook of FIG. 4 along the line V—V.
Figure 6:
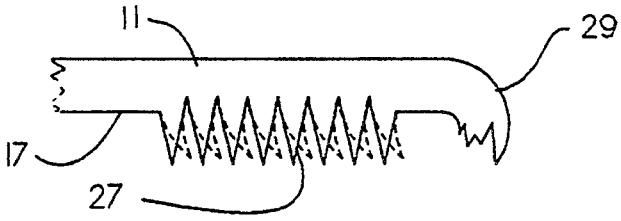
FIG. 6 is a side view of flexible protrusions of the door hook of FIG. 4.
Figure 8:
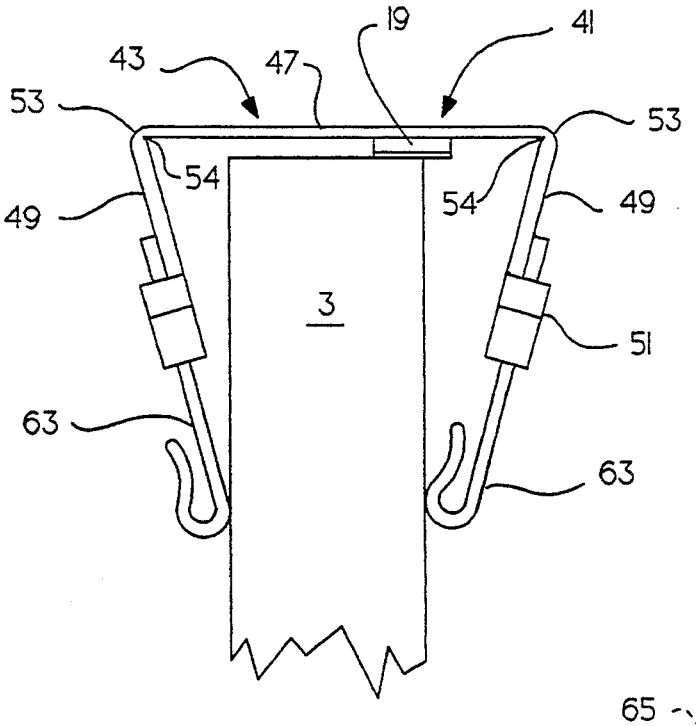
FIG. 8 is a side view of a fourth present preferred embodiment of a door hook secured over a door.

As shown in FIGS. 1, 2 and 4, door hooks 1 of this invention are to be positioned over a door top 5 extending to both sides 7 of a door 3. FIGS. 1 and 7 show a first present preferred embodiment of this invention. As shown in FIG. 1, the door hook 1 of the first preferred embodiment is comprised of a U-shaped bracket 9, a compressible pad 19 and a hook 21. The U-shaped bracket 9 is comprised of a top 11 which has a bottom surface 17, a front side 13 and a back side 15. The front side 13 is attached to one edge 29 of the top 11 at an acute angle relative to the bottom surface 17. The back side 15 is attached to an edge 29 of the top 11 opposite to the front side 13. The hook 21 is attached to the front side 13. The back side 15 is preferably angled inwardly toward the bottom surface 17 at an angle less than the front side 13 is angled inwardly toward the bottom surface 17. If desired, one could also attach a hook 21 to the back side 15.

The bracket 9 is made of polypropylene or polycarbonate. The top is preferably 0.050 to 0.070 inches thick to fit between a vast majority of door tops and jambs.

When an object is held on the hook 21, the front side 13 is pulled downward by the weight of the object. The downward force is likely to lift the back side 15 and the top 11 of the door hook 1. However, the acute angle between the front side 13 and the top 11 increases holding power of the door hook 1 and helps to keep the door hook 1 from being lifted. The acute angle between the back side 15 and the top 11 also increases holding power of the door hook 1 marginally more.

A door hook which is 0.050 to 0.070 inches thick and has a U-shaped bracket with no acute angles has been tested. Such door hook can hold an object up to 1 pound. A door hook 1 which has the same thickness and acute angles has been tested and held objects up to 5 pounds. Thus, the door hook 1 with acute angles has two to four times more holding power than a door hook with the same thickness but without these acute angles.

The compressible pad 19 is attached to the bottom surface 17 of the top 11. It is about 0.020 to 0.030 inches thick. The compressible pad 19 is preferably positioned close to the front side 13. The compressible pad 19 can spread across the bottom surface 17 completely, but it is not necessary. The compressible pad 19 right next to the front side 13 provides the same holding power as it does spreading across all of the bottom surface 17.

A door hook which is 0.050 to 0.070 inches thick and has a U-shaped bracket with no acute angles and no compressible pad has been tested. Such door hook can hold objects up to 1 pound. A door hook which has the same thickness and also has acute angles and the compressible pad 19 has been tested and held objects up to 10 pounds. This compressible pad 19 allows the door hook 1 to hold as much as ten to fifteen times more weight than a door hook would hold without the pad 19.

The compressible pad 19 can be made of cardboard but is too slippery. The best materials for making the compressible pad 19 are: 1. soft plastics, such as PVC or Telcar plastics, with low durometers under 90; 2. rubber with the same low durometer; 3. dense foam of similiar thickness and hardness; and 4. any thin, partly compressible material with a high frictional co-efficient.

The compressible pad 19 preferably has a releasable adhesive 23 on a surface which abuts the door top 5. Adhesives such as those used for 3M Post-It notes can be used.

Figure 3:
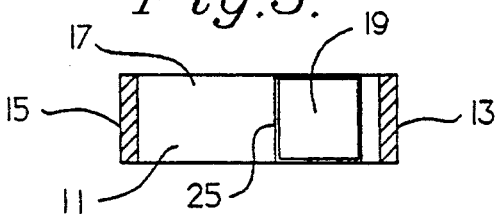
FIG. 3 is a cross-sectional view of the door hook of FIG. 2 along the line III—III.

FIGS. 2, 3 and 7 snow a second present preferred embodiment of this invention. As shown in FIGS. 2 and 3, the door hook 1 is molded with a ridge 25 in it to hold the compressible pad 19. Thus, the bottom surface 17 of the top 11 has a molded ridge 25 and the compressible pad 19 is attached to the ridge 25. All of the other features are the same as the first embodiment.

FIGS. 4, 5, 6 and 7 show a third present preferred embodiment of this invention. As shown in FIG. 4, a door hook 1 of the third embodiment is comprised of a U-shaped bracket 9, a hook 21 and flexible protrusions 27. The U-shaped bracket 9 and the hook 21 has the same features as the first embodiment. The flexible protrusions 27 play the same role as the compressible pad 19 of the first embodiment.

Minor flexible protrusions 27 molded into a harder plastic may provide the same holding advantages as the compressible pad 19. These flexible protrusions 27 are 1/32 to 1/64 inches long and ¾ to 1 inches wide. These protrusions 27 could be molded, for instance, into a door hook 1 of a harder durometer PVC, and their thickness and compressiblity would allow the door hook 1 to hold more weight. The door hook 1 with these flexible protrusions 27 will hold as much as 2 to 4 times more weight than it would hold without the protrusions.

Figure 9:
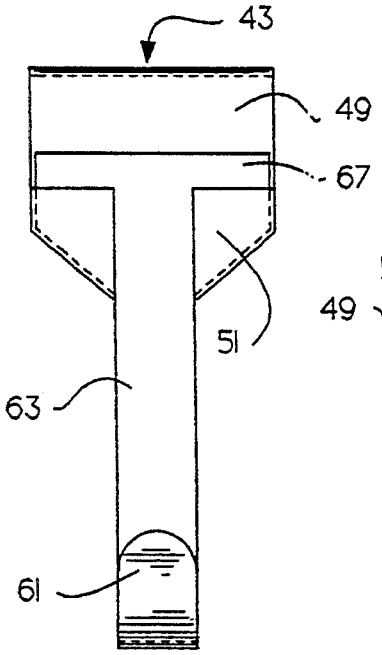
FIG. 9 is a front view of the embodiment of FIG. 8.
Figure 10:
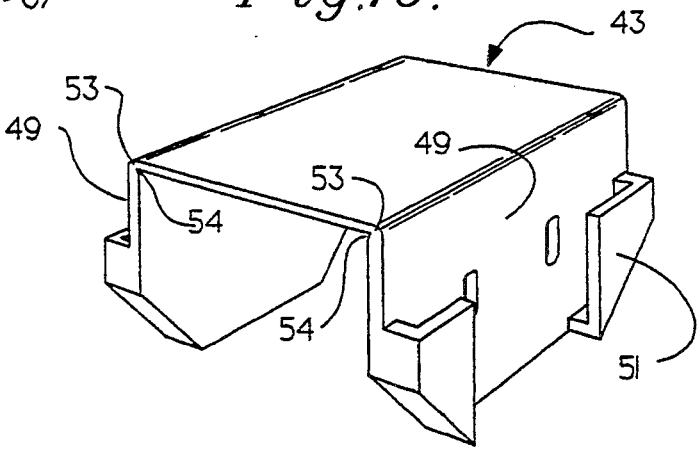
FIG. 10 is a perspective view of the bracket portion of the embodiment of FIG. 8.

FIGS. 8 through 11 show a fourth present preferred embodiment of this invention. As shown FIGS. 8 and 9, a door hook 41 of the fourth preferred embodiment is comprised of a bracket 43 and a hook arm 45. As shown in FIG. 10, the bracket 43 is of a reverse U-shape and has a thinner and wider top portion 47 than two side portions 49. The top portion 47 is preferably about 0.06 inches thick. The side portions 49 are preferably about 0.09 inches thick and 2 inches wide at angled corners 53 and and narrowed at ends. The bracket 43 is clear and made of injection molded plastic To provide the angled corners 53 with strength to sustain the weight of hanging objects. A notch 54 may be provided in the angled corners 53 which gives the door hook 41 greater downward pull strength. The bracket 43 may extends across the top of the door 3. A compressible pad 19 is positioned between the top portion 47 of the bracket 43 and the top of the door 3.

At least one side portion 49 has at least one locking nub 51 or fastening means to connect at least one hook arm 45 to the bracket 43. As shown in FIG. 9, the hook arm 45 is connected to the bracket 43 by being inserted into the locking nub 51. The locking nub 51 may be angled inward, to match similar angles in the bracket 43 so that the hook arm 45 would not pull out.

Figure 11:
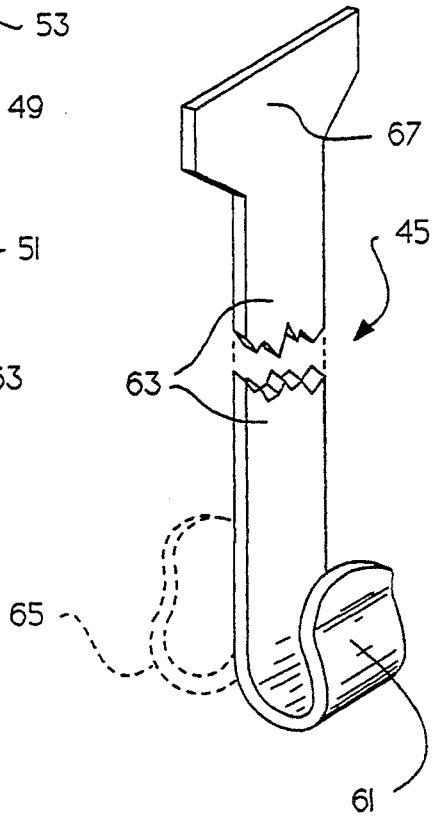
FIG. 11 is a perspective view of the hook portion of the embodiment of FIG. 8.

FIG. 11 shows a present preferred hook arm 45. The hook arm 45 is comprised of an arm portion 63 and a bottom hook portion 61. The hook arm 45 is preferably 11 inches long. Preferably, the arm portion 63 has an enlarged end 67 which is sized to fit into the locking nub 51 of the bracket 43. An object may be hang on the bottom hook portion 61 or an optional fixture 65 which extends out from the opposite side of the bottom hook portion 61.

Although I have shown the present preferred embodiments mounted on a door, my device could also be used as a mounting bracket in other environments.

I claim:

1. An improved mounting bracket to be extended over a door top to both sides of a door, comprising:

a) a U-shaped bracket having
  i) a top which has a bottom surface,
  ii) a front side which is attached to one edge of the top at an acute angle relative to the bottom surface of the top; and
  iii) a back side which is attached to an edge of the top opposite to the front side;
b) a compressible pad attached to the bottom surface of the top wherein the compressible pad has an adhesive surface which abuts the door top; and
c) a hook attached to the front side.

2. The improved mounting bracket of claim 1 wherein the adhesive is releasable.

3. The improved mounting bracket of claim 2 wherein the bottom surface of the top has a molded ridge to which the compressible pad is attached.

4. The improved mounting bracket of claim 3 wherein the back side is angled inwardly toward the bottom surface of the top.

5. The improved mounting bracket of claim 4 wherein the front side is angled more inwardly toward the bottom surface of the top than the back side.

6. The improved mounting bracket of claim 5 wherein a notch is provided between the bottom surface of the top and at least one of the front side and the back side.

7. An improved mounting bracket to be extended over a door top to both sides of a door, comprising:

a) a U-shaped bracket having
  i) a top which has a bottom surface,
  ii) a front side which is attached to one edge of the top at an acute angle relative to the bottom surface of the top, and
  iii) a back side which is attached to an edge of the top opposite to the front side;
b) a plurality of molded-in protrusions on the bottom surface of the top; and
c) a hook attached to the front side

8. The improved mounting bracket of claim 7 wherein the protrusions are about 1/32 to 1/64 inches long and ¾ to 1 inches wide.

9. The improved mounting bracket of claim 7 also comprising at least one locking nub attached to the front side of the U-shaped bracket, and the hook is comprised of an arm portion and a bottom hook portion, the arm portion being removably inserted into at least one locking nub.

10. The improved mounting bracket of claim 7 wherein a notch is provided between the bottom surface of the top and at least one of the front side and the back side.

11. The improved mounting bracket of claim 7 wherein the plurality of molded-in protrusions are flexible.

12. An improved mounting bracket to be extended over a door top to both sides of a door, comprising:

a) a U-shaped bracket having
  i) a top which has a bottom surface,
  ii) a front side which is attached to one edge of the top at an acute angle relative to the bottom surface of the top; and
  iii) a back side which is attached to an edge of the top opposite to the front side;
b) a compressible pad attached to the bottom surface of the top;
c) at least one locking nub attached to the front side of the U-shaped bracket; and
d) a hook attached to the front side, the hook comprised of an arm portion being removably inserted into at least one locking nub.

* * * * *